US005215765A

United States Patent [19]

Bergendahl

[11] Patent Number: 5,215,765

[45] Date of Patent: Jun. 1, 1993

[54] IRON SPONGE BRIQUETTING PRESS

[75] Inventor: Hans-Georg Bergendahl, Bochum, Fed. Rep. of Germany

[73] Assignee: Maschinenfabrik Köppern GmbH & Co. KG, Hattingen/Ruhr, Fed. Rep. of Germany

[21] Appl. No.: 722,767

[22] Filed: Jun. 27, 1991

[30] Foreign Application Priority Data

Jun. 28, 1990 [DE] Fed. Rep. of Germany ... 9007179[U]

[51] Int. Cl.[5] ..... B28B 13/02

[52] U.S. Cl. ..... 425/237; 100/93 RP; 100/176; 100/907; 165/89; 425/390; 492/46; 492/54

[58] Field of Search ..... 100/93 RP, 155 R, 176, 100/907; 425/237, 335, 363, 407, DIG. 230, DIG. 235, 390; 29/121.5, 121.2, 132; 165/89

[56] References Cited

U.S. PATENT DOCUMENTS

| | | | |
|---|---|---|---|
| 1,816,307 | 7/1931 | Von Reis | 165/89 |
| 2,908,486 | 10/1959 | Thornburg | 165/89 |
| 3,143,769 | 8/1964 | Komarek et al. | 100/907 X |
| 3,942,230 | 3/1976 | Nalband | 100/155 R X |
| 4,727,740 | 3/1988 | Yabuki et al. | 29/132 X |

FOREIGN PATENT DOCUMENTS

| | | | |
|---|---|---|---|
| 790337 | 2/1958 | United Kingdom | 425/237 |
| 814970 | 6/1959 | United Kingdom | 425/237 |

*Primary Examiner*—Harvey C. Hornsby
*Assistant Examiner*—Stephen F. Gerrity
*Attorney, Agent, or Firm*—Skjerven, Morrill, MacPherson, Franklin & Friel

[57] ABSTRACT

The invention relates to an iron sponge briquetting press having two opposite rollers. The rollers consist of a roller base body and a coating affixed thereto, in which the moulding recesses for shaping the briquettes are formed. In order to provide less expensive roller coatings as compared with the segments used formerly as coating, which have moreover longer service lives, the invention provides that the coating is produced as a closed ring from a chromium nickel molybdenum steel and is held in press fit on the roller base body. Open grooves are produced in the sleeve surface of the roller base body or on the inner side of the ring as cooling ducts, their open sides being covered by the inner side of the ring or the sleeve surface of the base body in the assembled condition of the rollers.

4 Claims, 3 Drawing Sheets

IRON SPONGE BRIQUETTING PRESS

BACKGROUND OF THE INVENTION

1. Field of the invention

The invention relates to an iron sponge briquetting press having two opposite rollers provided with cooling ducts, each roller comprising a roller base body and a coating affixed thereto with moulding recesses for shaping the briquettes in a nip formed by both rollers.

2. Description of the Prior Art

Iron sponge is an ore, where the nonferrous components are removed so that subsequently a spongy structure with a very high pore volume is left over. This iron sponge is briquetted at temperatures of about 700° C., before it is further processed in furnaces. The material to be briquetted consists substantially of iron oxide and gangue material, i.e. minerals leading to a heavy wear of the roller coating. The iron sponge to be briquetted can be shaped relatively well due substantially to the high processing temperature of about 700° C.; however, the minerals remaining in the iron sponge nevertheless cause heavy wear.

Therefore briquetting presses have been used for the briquetting of iron sponge for about 20 years, said presses having coating comprising an especially hard, wear-resistant material. This material is designated as M3 according to the US Standard and S653 (steel code 1.3344) according to the DIN Standard. This material provides for relatively hard and wear-resistant surfaces of the coating and the moulding recesses formed therein.

Ring segments were produced from this material which were tightened on the roller base body via laterally engaging clamping rings. Segments were not only used for the coating, because the material is too brittle so that it cannot be processed in greater dimensions, but also due to the high differences in temperature and the heat expansion and shrinking of the coating of the rollers connected therewith. Despite the relatively high specific pressing force of the rollers which is at 120 to 140 kN/cm (width of the nip), the segment service lives are relatively long. However, damage due to local, punctiform overloads occur again and again, which are caused by foreign bodies contained in the iron sponge. It would be possible per se to exchange only individual segments in case of such damage. However, this exchange is only possible if the exchange segment has the same wear condition. Since such segments are only rarely available as an individual segment, an entire set of segments must mostly be exchanged. This reduces the average service life of the segments and leads above all to unplanned standstills.

Apart from the fact that the production of the coating used so far is difficult due to the material used, the coatings are also expensive.

Therefore it is the object of the present invention to improve an iron sponge briquetting press so that the roller coatings are less expensive, more easily to process and less sensitive to local overloads.

SUMMARY OF THE INVENTION

This object is accomplished according to the invention by the fact that the coating is made as a closed ring from a chromium nickel molybdenum steel and is held on the roller base body in a press fit and that the cooling ducts are formed by open grooves produced in the sleeve surface of the roller base or the inner side of the ring, whose open sides are covered by the inner side of the ring or the sleeve surface of the roller base body in assembled condition of the rollers.

The closed ring of the chromium nickel molybdenum steel is less hard than the material used so far for the coatings and can therefore be processed substantially more easily. Such an effective cooling of the ring can be effected by providing the cooling ducts at the boundary layer between the roller base body and the ring that the surface of the ring has a temperature of only about 150° C. despite the briquetting of the iron sponge which has still a temperature of 700° C. A further advantage of this design of the cooling grooves is that the grooves are easily exchanged in the case of an exchange of the coating or can be cleaned easily, depending upon whether the grooves are formed on the inner side of the ring or in the sleeve surface of the roller base body. Thus, it must not be feared that the effectiveness of the cooling deteriorates with increasing age of the briquetting press.

A further benefit of the present invention is that the wear characteristics of the chromium nickel molybdenum coating are no worse than those of the harder and more brittle material used in the prior art. Furthermore, the service life of a roller with a chromium nickel molybdenum coating is generally longer than that of a roller of the prior art as eruptions due to local overload are practically eliminated, eliminating the need for premature coating replacement. The relative elimination of local eruptions and the uniform wear of the chromium nickel molybdenum coating of the present invention allows the replacement of shaping tools to be planed in advance and to be better integrated into the course of iron briquette production.

It was previously believed in the prior art that long service life of a coating of a press for briquetting iron sponge could only be achieved with a coating of especially great hardness. While coatings of softer materials in the form of closed rings were used in other applications; e.g., during briquetting of coal, salts, metallurgical dusts and the like; such coatings were never used in the briquetting of iron sponge due to the particular characteristics of iron sponge.

Although it would also be conceivable to provide the cooling ducts in the form of multiply wound, helical grooves in the sleeve surface of the roller base body, it is preferred that the cooling ducts have in each case a multiply wound, helical groove in the ring, substantially radial connection bores being provided in the roller base body at the level of the beginning and the end of the helix. The advantage of this is that the cooling ducts are also exchanged with the exchange of the coating ring so that a uniform cooling effect is maintained with the coating rings for the entire service life of the briquetting press. The provision of the cooling ducts in the ring has moreover the advantage that the available heat exchange surface between the ring and the cooling ducts is enlarged. Thus it is possible by means of the direct water cooling to keep the ring that cold so that the shrinking of the ring is maintained almost to the entire extent.

According to a especially preferred embodiment the rings consist of a DIN 56NiCrMoV7.3 steel. This steel lends itself well to processing and contributes significantly to long service lives of the coating rings.

DETAILED DESCRIPTION OF PREFERRED EMBODIMENTS

Figure 1:
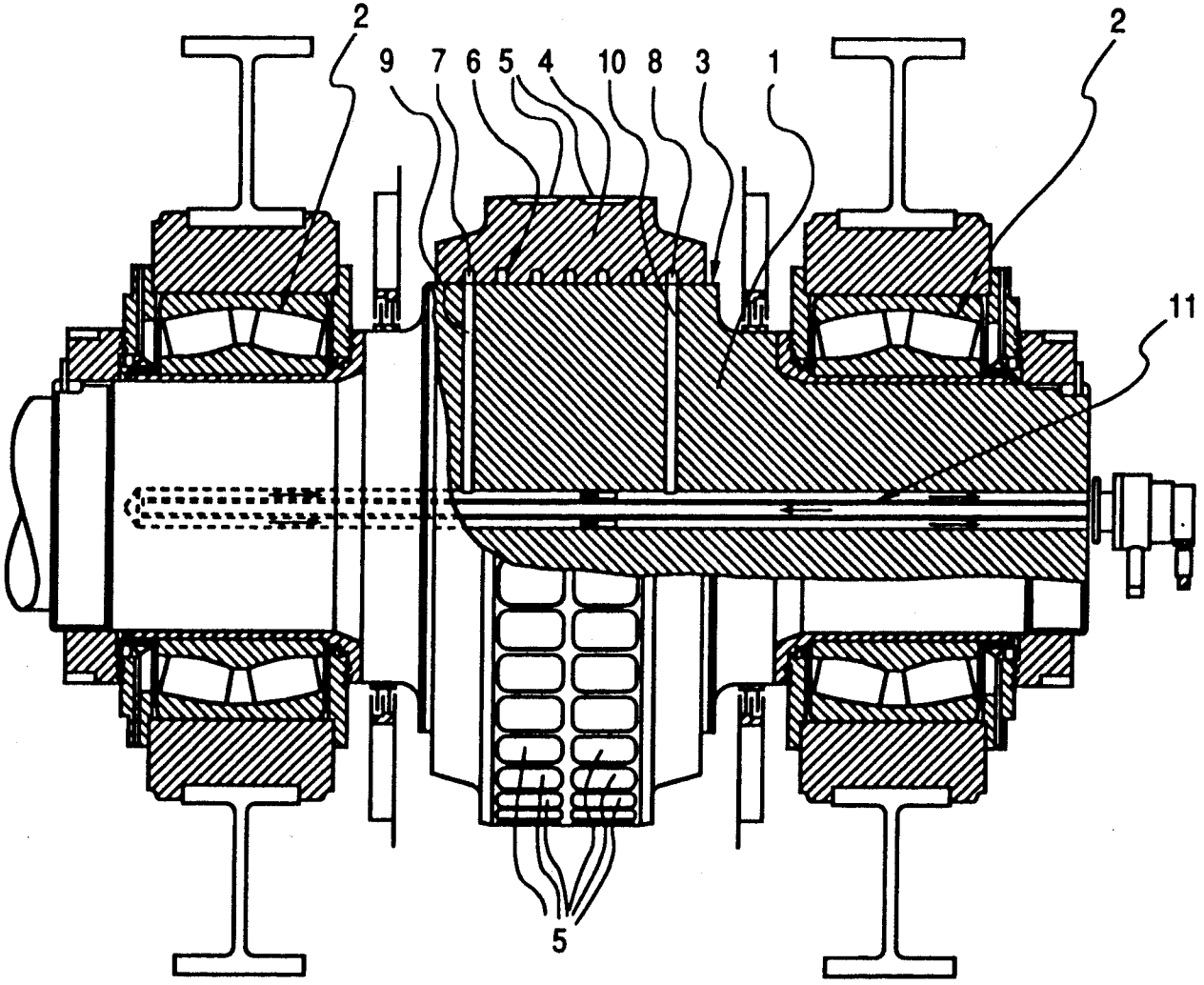
FIG. 1 is a cross-sectional view of an iron sponge briquetting press roller in accordance with one embodiment of the present invention.

An example of embodiment of the invention is explained in the following in greater detail by means of a drawing. FIG. 1 shows, partly in a longitudinal section, a roller of an iron sponge briquetting press according to an example of embodiment of the invention. The roller consists of a base body 1, which is rotatably mounted in two self-aligning roller bearings 2.

A coating ring 4 is shrunk on the sleeve surface 3 of the base body 1, in whose outer sleeve surface the briquette moulds 5 are formed. The coating ring 4 consists of a steel with the designation DIN 56NiCrMoV7.3 (steel code 1.2714). A multiply helically wound groove 6 is formed on the inner side of the coating ring 3 facing the sleeve surface 3, which is open towards the sleeve surface 3. The groove 6 extends helically from the first winding 7 to the last winding 8.

Figure 3:
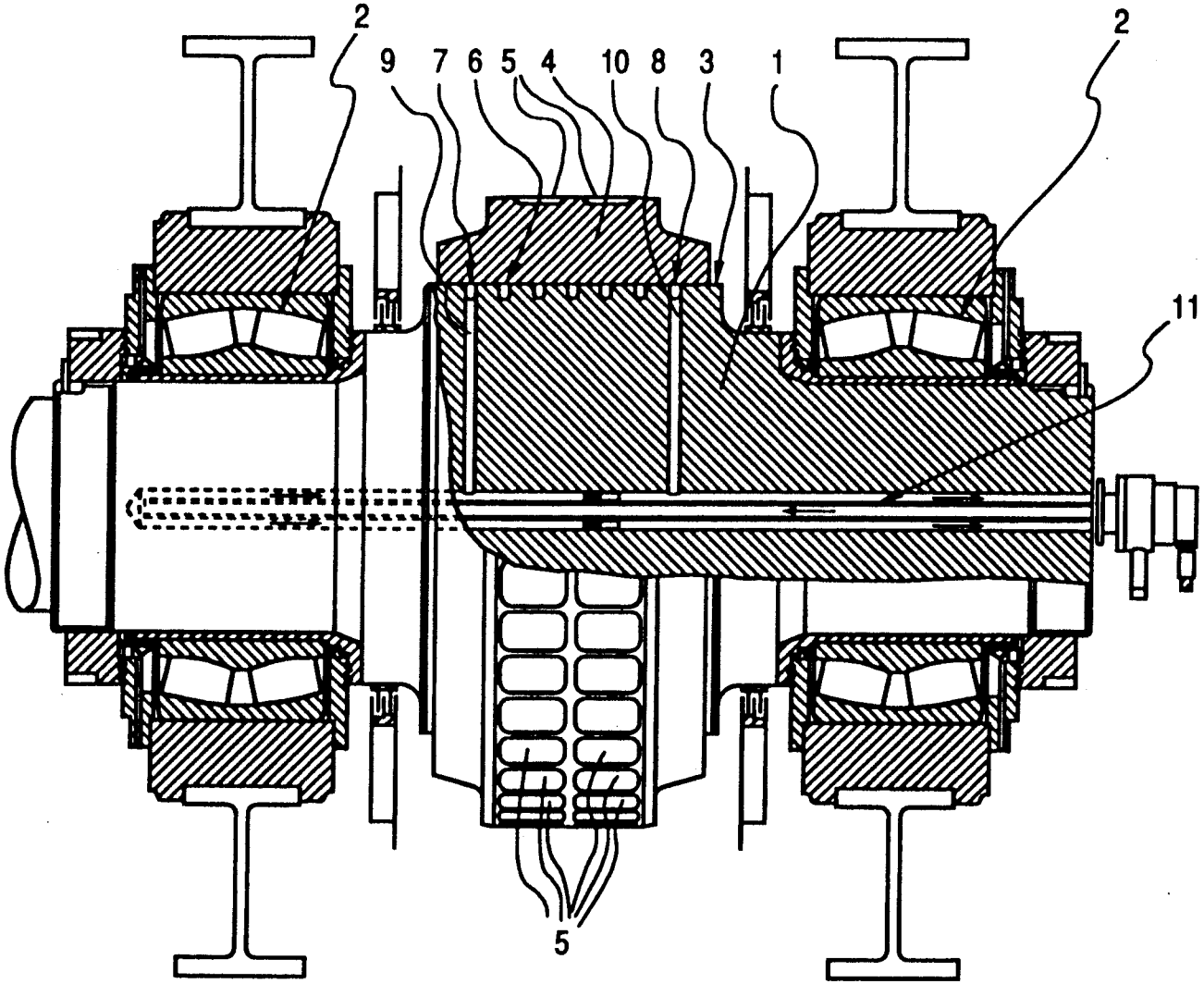
FIG. 3 is a cross-sectional view of an iron sponge briquetting press roller in accordance with another embodiment of the present invention.

FIG. 3 shows another embodiment in which groove 6 is formed on the sleeve surface of base body 1.

Corresponding radial connection bores 9 and 10 are formed in the roller base body 1, which are connected with a central coolant supply 11.

The action and function of the iron sponge briquetting press according to the invention is as follows:

The ring is correspondingly heated and slipped on to mount the coating ring 4 on the base body 1. Due to the cooling effected by coolant flow through groove 6, the coating ring 4 then sits in press fit on the sleeve surface 3 of the base body 1, namely in such fashion that in each case the first winding 7 of the cooling groove 6 is connected with the connection bore 9 and the last winding 8 is connected with the connection bore 10 of the central coolant supply 11.

Figure 2:
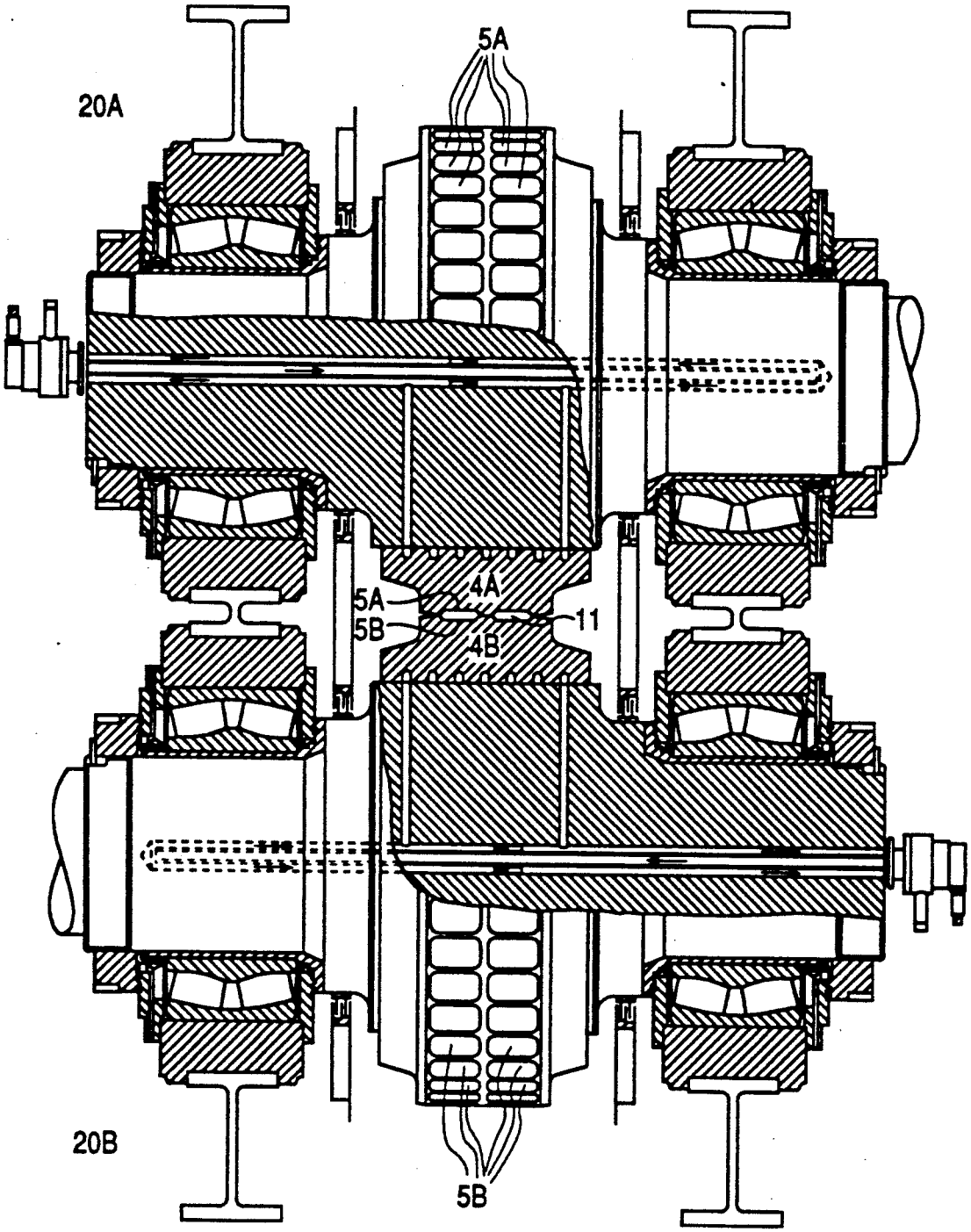
FIG. 2 is a cross-sectional view of an iron sponge briquetting press having two press rollers in accordance with the present invention.

As shown by FIG. 2, two rollers are positioned such that a nip 11 is formed between briquetting moulds 5A and 5B of respective rollers 20A and 20B for the formation of iron briquettes.

During operation of the iron sponge briquetting press, coolant flows through the coolant groove 6, namely in such fashion that, despite the briquetting of the iron sponge which has a temperature of about 700° C., the surface temperature of the coating ring 4 is only about 150° C. This cooling is sufficient to keep the coating ring 4 substantially on the base body 1 by means of the press fit. The wear of the coating ring 4 is moreover reduced by the cooling. The material used for the coating ring 4 is surprisingly wear-resistant despite its relatively low hardness and moreover insusceptible to material eruptions caused by local overloads due to foreign materials as they can occur due to the gangue material of the iron sponge.

I claim:

1. An iron sponge briquetting press having two opposite rollers forming a press nip, each said roller comprising:

a roller base body having a sleeve surface and a coating affixed thereto;

said coating formed as a closed ring of a nickel chromium molybdenum steel having an inner side affixed in a press fit to said sleeve surface of said roller base body and an outer side having molding recesses for shaping briquettes in said press nip;

and cooling ducts formed by open grooves produced in the inner side of the ring, wherein the open side of said grooves is closed by the sleeve surface of the roller base body.

2. An iron sponge briquetting press according to claim 1, wherein said cooling ducts are formed as multiply wound, helical groove in the inner side of the ring and further comprising substantially radial connection bores formed in the roller base body at the beginning and end of the multiply wound, helical groove.

3. An iron sponge briquetting press according to claim 2, wherein each closed ring consists of a DIN 56NiCrMoV7.3 steel.

4. An iron sponge briquetting press according to claim 1, wherein each closed ring consists of a DIN 56NiCrMoV7.3 steel.

* * * * *